United States Patent [19]

Gloor et al.

[11] Patent Number: 5,014,394

[45] Date of Patent: May 14, 1991

[54] METHOD AND APPARATUS FOR MAKING REPRESENTATIVE SAMPLES OF TEXTILE FIBERS

[75] Inventors: René Gloor, Richterswil; Michael Müller, Wädenswil; Alfred Beeler, Horgen, all of Switzerland

[73] Assignee: Siegfried Peyer AG, Wollerau, Switzerland

[21] Appl. No.: 498,766

[22] Filed: Mar. 26, 1990

[30] Foreign Application Priority Data

Apr. 10, 1989 [CH] Switzerland ..... 01340/89

[51] Int. Cl.[5] ..... D01G 33/00

[52] U.S. Cl. ..... 19/98

[58] Field of Search ..... 19/98, 99, 296, 297, 19/112

[56] References Cited

U.S. PATENT DOCUMENTS

| | | | |
|---|---|---|---|
| 3,556,665 | 1/1971 | Hertel | 356/238 |
| 4,461,141 | 7/1984 | Hofmann et al. | 19/112 X |
| 4,827,781 | 5/1989 | Völlm | 73/864.41 |

FOREIGN PATENT DOCUMENTS

| | | |
|---|---|---|
| 2421370 | 11/1975 | Fed. Rep. of Germany . |
| 488187 | 5/1970 | Switzerland . |
| 637468 | 7/1983 | Switzerland . |

*Primary Examiner*—W. C. Reynolds
*Assistant Examiner*—John J. Calvert
*Attorney, Agent, or Firm*—Walter C. Farley

[57] ABSTRACT

A disordered material of staple fibers is separated into individual uniform and parallel fibers to prepare representative, textile samples. A piece of the original fiber material (6) to be analyzed is moved into a space between two mutually parallel disks (1, 2) which are held at a constant distance from each other and are equipped with sets of mutually engaging needles with serrate profiles (3, 4) which penetrate the fiber material (6). The two disks (1, 2) are moved relative to each other while preserving their mutual spacing and the needles linearly resolve the fiber material (6) into its individual fibers. A sample clamp (5) is used to remove a random, orthogonal cross-sectional sample (11), which sample (11) substantially matches by its composition that of the original fiber material (6) and accordingly is suitable for carrying out diverse quality tests.

10 Claims, 5 Drawing Sheets

17
7
2
10
4
1
16
3
8

METHOD AND APPARATUS FOR MAKING REPRESENTATIVE SAMPLES OF TEXTILE FIBERS

The invention relates to a method for making representative samples of textile fibers and equipment with which to carry out the method.

BACKGROUND OF THE INVENTION

Today's known procedures to obtain uniform and parallel samples of staple fiber materials in the textile industry favor the selection of long fibers. As a result, the prepared fiber samples generally contain an artificially enlarged proportion of long fibers compared to the original product, thereby rendering spurious the measurements and tests to be carried out on the fiber sample.

The equipment described in the Swiss patent document A 488,187 is representative of the present state of the art: the fiber material is removed by means of a rake from a perforated drum system. Because of higher likelihood of seizing long fibers, such sampling leads to enrichment in long fibers in the sampled batch, i.e., a fiber length distribution pattern which is weighted in favor of the long fibers is obtained.

Again, in the known method of the Swiss patent document A 637,468 wherein the measurement of the length distribution of textile fibers is carried out by dissociating a fiber web in an air current by fixing the individual fibers on a revolving sifting drum and then by optically determining the fiber lengths, the measurements are in part spurious because stretching the fibers results from their having been wound around the drum. Accordingly it is impossible to obtain a representative length distribution pattern. Moreover, aspiration by the drum further falsifies the test results because small fibers are sucked inside the sifting drum and are not available for the measurements.

SUMMARY OF THE INVENTION

An object of the invention is to improve the fiber analysis techniques and to arrive in a simple and reliable manner at a substantially unweighted or unbiased fiber length distribution pattern.

Briefly described, the invention comprises a method for preparing representative samples of textile fibers comprising the steps of providing two surfaces with sets of protrusions, positioning the surfaces so that they are parallel with each other and so that the set of protrusions on each surface extends generally toward the other surface, moving a web of fiber material to be analyzed into the space between the two parallel surfaces while holding the surfaces at a constant distance from each other, rotating the two surfaces about a common axis so that the protrusions enter the fiber material and linearly resolve the fiber material into its individual fibers to produce a random, orthogonal cross-sectional sample and removing the sample from between the surfaces.

In another aspect, the invention comprises an apparatus for preparing representative samples of textile fibers from a web formed from those fibers comprising first and second bodies having surfaces each having thereon a set of protrusions, means for supporting said surfaces so that they are parallel with each other, are spaced apart by a predetermined distance and are rotatable about an axis common to both said surfaces and so that each set of protrusions on each surface extends generally toward the other surface, means for feeding a web of fiber material to be analyzed into the space between the two parallel surfaces while holding the surfaces at said constant distance and rotating the two surfaces about said common axis so that the protrusions enter the fiber material and linearly resolve said web of fiber material into its individual fibers to produce a random, orthogonal cross-sectional sample, and means for removing the sample from between the surfaces.

Among the advantages of the invention are that, thanks to its method, a representative quantity of staple fiber material can be resolved without losses to produce an unweighted lab sample.

BRIEF DESCRIPTION OF THE DRAWINGS

An illustrative embodiment of the invention is described with reference to the accompanying drawings wherein:

FIG. 3 is a perspective view of an apparatus in accordance with the invention in the stage of sample extraction;

DETAILED DESCRIPTION OF THE PREFERRED EMBODIMENT

The figures show apparatus for making the fibers of a material of staple fibers parallel and uniform for the purpose of preparing in the manner of the invention representative textile fiber samples, which apparatus in its basic design consists of two mutually engageable disks 1 and 2 the spacing between which is continuously adjustable, the inwardly facing surfaces of the disks being fitted with corresponding sets of protrusions which, in the embodiment shown, comprise sets of carding needles 3 and 4. The spacing between the two disks 1 and 2 is optimized between 0 and 10 mm depending on the characteristics of the raw material and is fixed during use.

Figure 1:
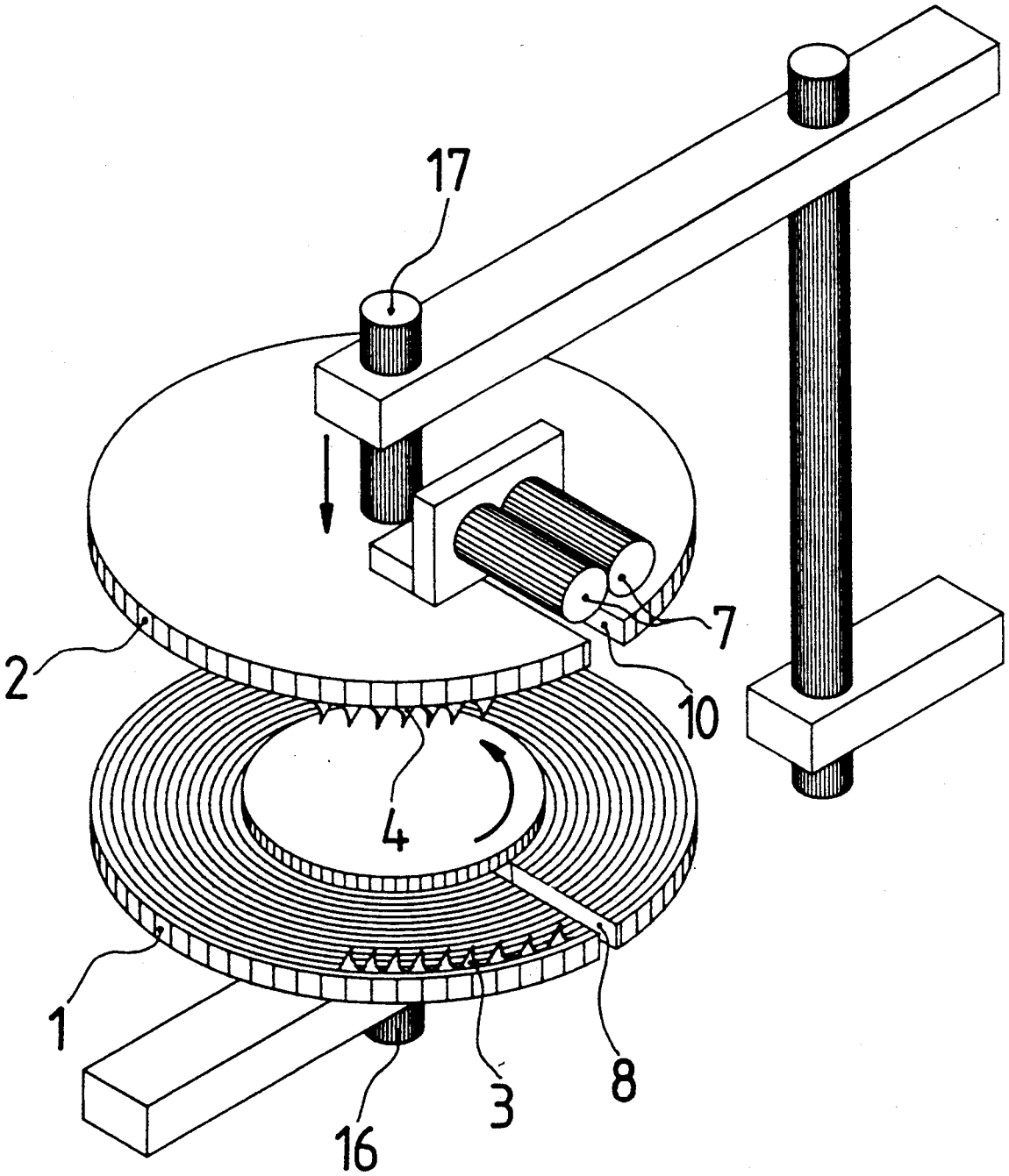
FIG. 1 is a perspective view of an apparatus in accordance with the invention implementing the method of the invention with the disks thereof separated.
Figure 6:
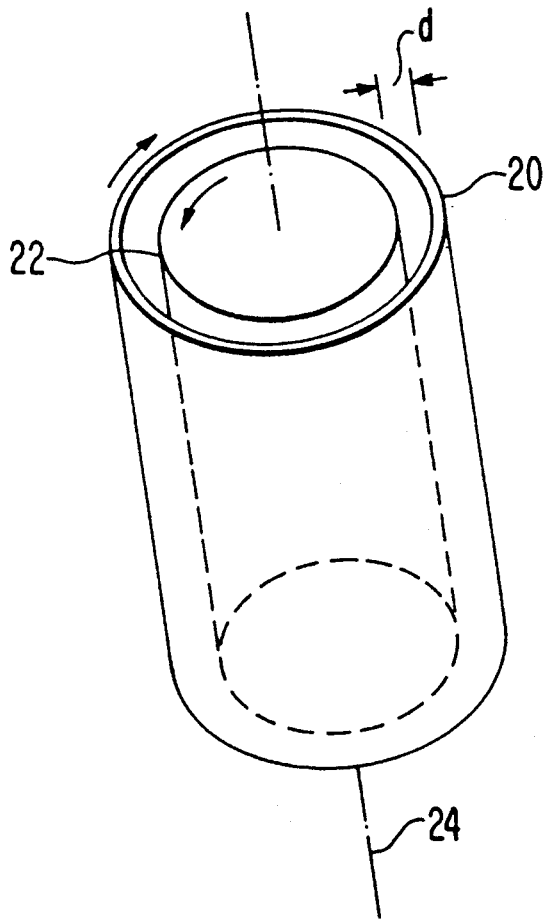
FIG. 6 is a perspective view of a further embodiment of an apparatus in accordance with the invention using coaxial cylinders.

In the preferred embodiment shown in FIG. 1, the disks 1 and 2 are circular. However in general other geometries may be employed, illustratively two mutually parallel cylindrical surfaces as shown in FIG. 6.

Figure 2:
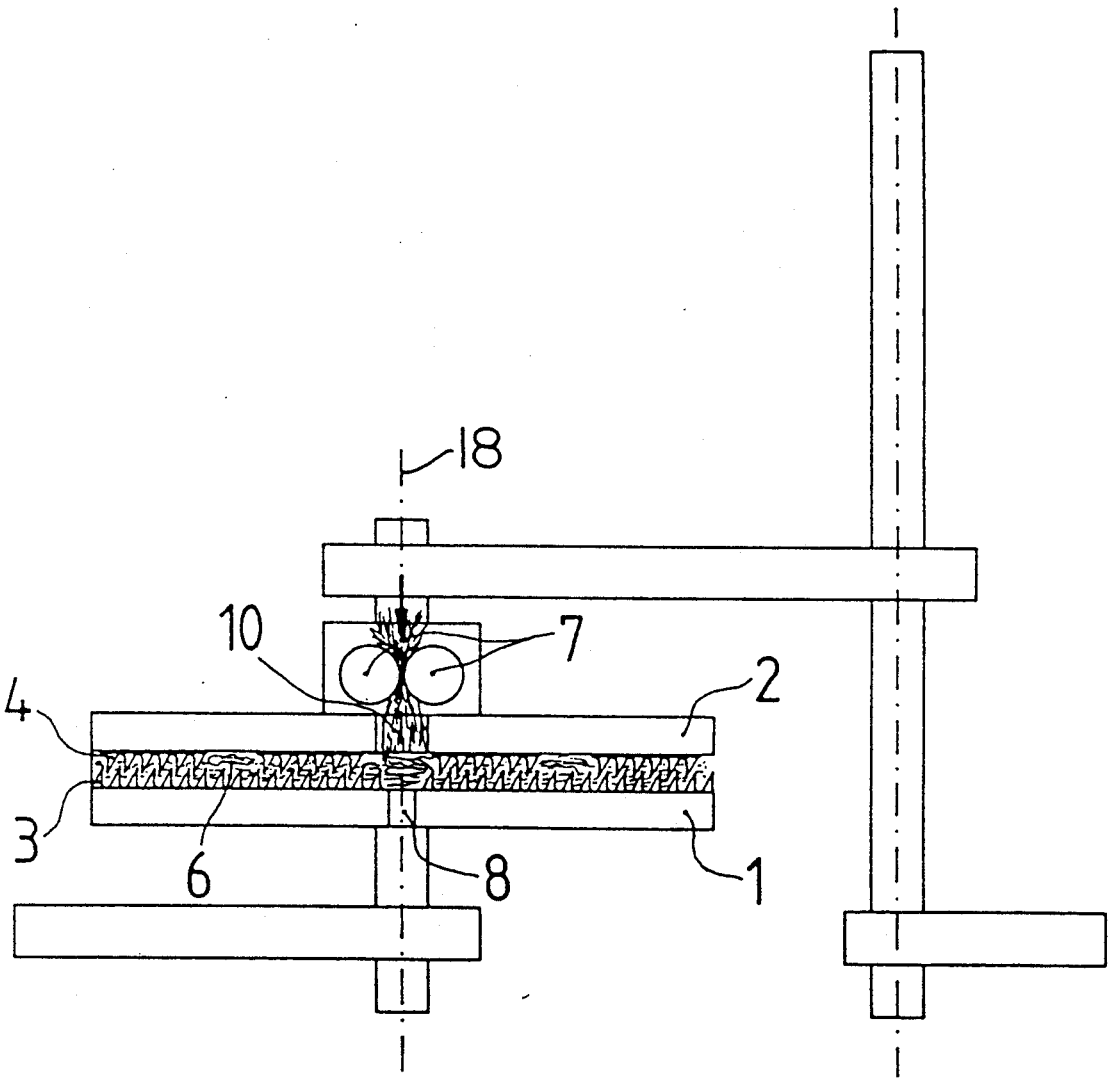
FIG. 2 is a side elevation of the apparatus of FIG. 1 during loading and sample preparation.

The sets of carding needles 3 and 4 on the two disks 1 and 2 consist of a series of small hooks on the disk 1 and of matching hooks on the other disk 2. Preferably, and as shown in FIG. 2, the two sets of carding needles 3 and 4 evince a serrate profile. However, combinations of different needle set geometries are also possible, for instance a serrate profile on the upper disk 2 and small hooks on the lower disk 1, or vice-versa.

In the preferred embodiment shown in FIG. 1, the upper disk 2 carries a feed device 7 for feeding fiber material 6 into the region between disks 1 and 2, the feeding device including a pair of parallel, cooperating rollers.

The lower disk 1 is formed with a sample evacuation slot 8 which allows inserting a sample clamp 5 (FIG. 4) having two combs 13 and 14 pivotably interconnected at one end by a hinge 12. At the other end, a latch 15 allows the two free ends of the combs 13 and 14 to be locked together.

The disks 1 and 2 are mounted on axially movable shafts 16 and 17, respectively, which are on a common axis 18 (FIG. 2) and to which rotation can be imparted by hand or machine.

The method of the invention will be described with reference to the figures which illustrate different operational stages.

As shown by FIGS. 1 and 2, the two disks 1 and 2 are moved toward each other by longitudinally moving shafts 16 and 17 until the disks are in the operational position, the distance between the two disks 1 and 2 being adjusted as a function of the amount of material and its nature.

Next, a web 6 of fiber material is moved through the feed device 7 into the space between the disks 1 and 2 while the disks are caused to rotate relative to each other in opposite directions, each disk having a set of carding needles 3 and 4.

Because of the mutually opposite rotation of the disks 1 and 2, one of the two carding needles 3 exerts a retaining force on the fiber material web 6 and the other set of carding needles 4 exerts a pull-out force. The lower disk 1 may be rotated more slowly than the upper disk 2 or vice-versa.

In this procedure, shown in FIG. 2, a fiber pattern with radial and mutually extensively parallel fiber axis is obtained from the original fiber web 6. After a suitable interval of fiber separation, the rotation of the disks is stopped.

Figure 4:
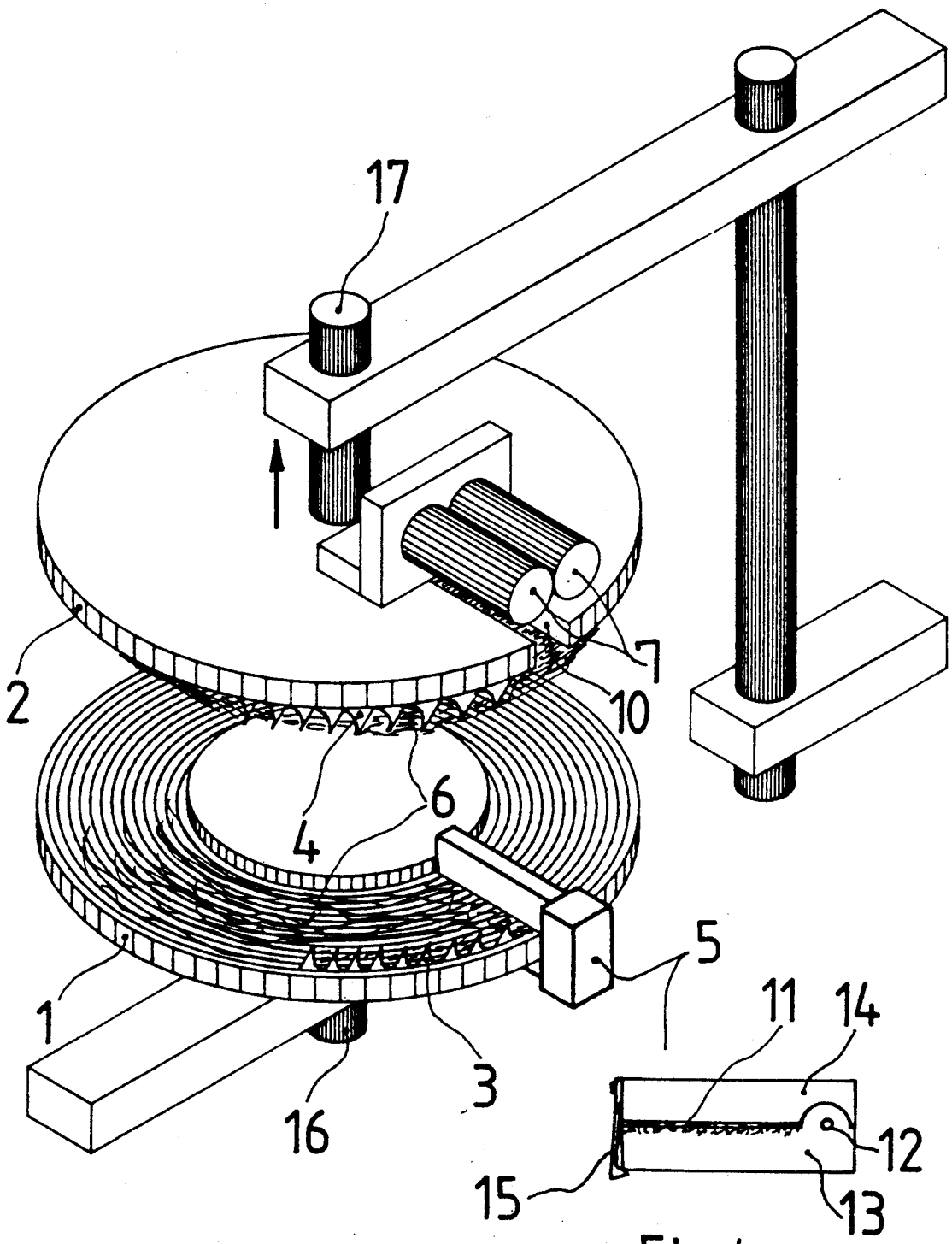
FIG. 4 is a side elevation of a sample clamp usable in the apparatus of FIG. 3 for removing the fiber sample.

FIG. 3 shows a stage of the process in which a fiber sample is removed from the disks, this step being assisted by use of the sample clamp 5 shown in FIG. 4. After the disks 1 and 2 have come to rest, the sample clamp 5 is inserted with open combs 13 and 14 into the sample removal slot 8 after which the combs are closed and locked by means of the latch 15, such that a tuft of fibers 11 is held in slip-proof manner in the sample clamp 5. Next the disks 1 and 2 are moved apart and the tuft of fibers 11 can be removed together with the sample clamp 5.

The fiber sample, or, more accurately, the tuft of fibers 11, as a rule is then rid of fibers which are not held by the sample clamp by suitable brushing. A fiber-sample tuft 11 so prepared can be used as a test specimen for various determinations such as fiber length, fiber maturity, fiber fineness, fiber color and fiber strength.

Figure 5:
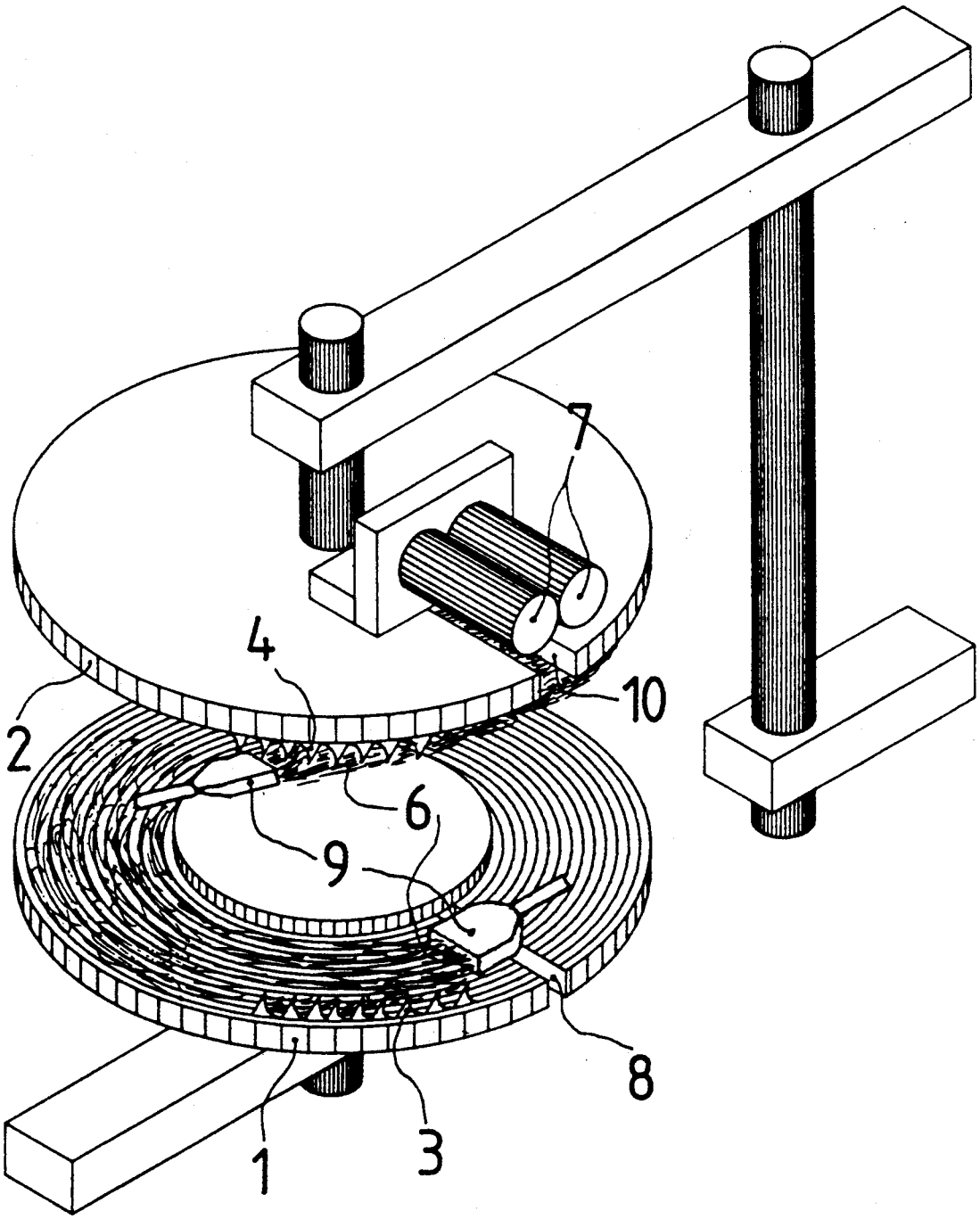
FIG. 5 is a perspective view of the apparatus implementing the method of the invention when resetting for the next fiber sampling.

The resetting stage for the next fiber-sample tuft preparation shown in FIG. 5 begins with moving apart the two disks 1 and 2. Once in the opened state, the fibers 6 remaining in the carding needles 3 and 4 are removed by resorting to suction and/or brushing devices 9 and the two disks 1 and 2 are returned to their operational position (FIGS. 1 and 2).

As shown in FIG. 6, an apparatus using two cylinders includes an outer cylinder 20 and an inner cylinder 22, arranged for rotation about a common axis 24 in opposite directions as indicated by the arrows. The outer surface of cylinder 22 and the inner surface of cylinder 20 are spaced apart by the distance d and are provided with needles or the like, as described in connection with disks 1 and 2.

What is claimed is:

1. A method for preparing representative samples of textile fibers comprising the steps of providing two surfaces (1, 2) with sets of protrusions (3, 4), positioning the surfaces (1, 2) so that they are parallel with each other and so that the sets of protrusions on each surface extend generally toward the other surface, moving a web of fiber material (6) to be analyzed between the two parallel surfaces (1, 2) while holding the surfaces at a constant distance from each other and rotating the two surfaces about a common axis so that the protrusions enter the fiber material (6) and linearly resolve the fiber material (6) into its individual fibers to produce a random, orthogonal cross-sectional sample (11), and removing the sample from between the surfaces.

2. A method according to claim 1, wherein the step of positioning includes setting the constant distance between the two surfaces (1, 2) at no more than 10 mm.

3. A method according to claim 2, wherein each of the two surfaces (1, 2) is formed with an aperture (8, 10) and wherein the step of removing the sample includes aligning the apertures in the two parallel surfaces through which the fiber sample can be removed.

4. An apparatus for preparing representative samples of textile fibers from a web formed from those fibers comprising first and second bodies having surfaces (1, 2) each having thereon a set of protrusions (3, 4);

means for supporting said surfaces (1, 2) so that they are parallel with each other, are spaced apart by a predetermined distance and are rotatable about an axis common to both said surfaces and so that each set of protrusions on each surface extends generally toward the other surface, means for feeding a defined length of a web of fiber material (6) to be analyzed between the two parallel surfaces (1, 2) while holding the surfaces at said constant distance and rotating at least one of said surfaces relative to the other about said common axis so that the protrusions enter the fiber material (6) and linearly resolve said web of fiber material (6) into its individual fibers to produce a random, orthogonal cross-sectional sample (11), and means for removing the sample from between the surfaces.

5. An apparatus according to claim 4, wherein each of said two bodies is a circular disk, and each disk is provided with means defining a radially extending slot (8, 10).

6. An apparatus according to claim 5 wherein said apparatus further comprises a sample clamp insertable into said radially extending slots for removing a sample of fibers from between said disks.

7. An apparatus according to claim 5 wherein at least one of said sets of protrusions comprises a plurality of carding needles (3, 4) having a serrate profile.

8. An apparatus according to claim 4, wherein the two surfaces (1,2) are two cylindrical surfaces.

9. An apparatus according to claim 4, wherein the set of protrusions (3) on one surface (1) comprises a plurality of small hooks and the set of protrusions (4) on the other surface (2) comprises a plurality of matching hooks.

10. An apparatus according to claim 6, wherein the apertures (8, 10) are perpendicular to the linear direction of the fiber material (6) to be analyzed.

* * * * *